United States Patent [19]

Elliott

[11] Patent Number: 4,534,792

[45] Date of Patent: Aug. 13, 1985

[54] MAGNESIUM REDUCTION OF URANIUM OXIDE

[76] Inventor: Guy R. B. Elliott, 133 La Senda Rd., Los Alamos, N. Mex. 87544

[21] Appl. No.: 446,762

[22] Filed: Jan. 27, 1983

[51] Int. Cl.[3] ..... C22B 5/00; C22B 60/02

[52] U.S. Cl. ..... 75/84.1 R; 75/84.1 A; 75/89

[58] Field of Search ..... 75/84.1 R, 84.1 A, 84, 75/89, 27

[56] References Cited

U.S. PATENT DOCUMENTS 3,088,823 5/1963 Magofeaux ..... 75/84.1 R
4,295,884 10/1981 Hicter et al. ..... 75/68 R

FOREIGN PATENT DOCUMENTS 0804063 11/1958 United Kingdom ..... 75/84.1 R
0804064 11/1958 United Kingdom ..... 75/84.1 R

OTHER PUBLICATIONS

Trapp, Pressurized Low Temperature Reduction of Green Salt, National Lead Co. of Ohio Report, NLCO-1058, Sep. 1970.

Wilkinson, Uranium Metallurgy, Interscience Publishers, N.Y., 1962, pp. 165, 167, 172, 173.

*Primary Examiner*—Ben R. Padgett
*Assistant Examiner*—Anne Brooks

[57] ABSTRACT

A method and apparatus are provided for reducing uranium oxide with magnesium to form uranium metal. The reduction is carried out in a molten-salt solution of density greater than 3.4 grams per cubic centimeter, thereby allowing the uranium product to sink and the magnesium oxide byproduct to float, consequently allowing separation of product and byproduct.

15 Claims, 5 Drawing Figures

MAGNESIUM REDUCTION OF URANIUM OXIDE

BACKGROUND OF THE INVENTION

This invention relates generally to a method and apparatus for reducing uranium oxide by reaction with magnesium in a molten-salt medium of high density, thereby generating and isolating uranium as bulk metal. In this disclosure, unless otherwise specified, the term "uranium" is defined to include substantially metallic alloys comprising at least 50 percent by weight of the element uranium. Likewise, "uranium oxide" is defined to include substantially oxide mixtures of solutions comprising at least 50 percent by weight of oxides of the element uranium. Thus, for example, "uranium" refers to (among other materials) a militarily useful alloy produced from elemental uranium plus 7.5% niobium. If this alloy is burned, the product is uranium oxide, even though niobium oxide is present. Later reduction of this uranium oxide would return it substantially to an alloy containing 7.5% niobium, again to be included under the term "uranium."

Because much uranium scrap can be pyrophoric or flammable, such scrap often is deliberately burned before storage or burial as radioactive waste. There now is no simple way to return such oxidized scrap to useful metal.

Magnesium is used commercially as a reactant for converting uranium fluoride to uranium in bomb reductions. Such reductions involve preheating the mixtures of magnesium-uranium fluoride reactants prior to initiation of the reduction reaction. If thus preheated, the hot mixtures will fuse to molten products when supplied the additional heat of the reduction reaction. Even though such fusions produce high pressures of magnesium vapor, with corollary need for expensive high-pressure vessels, still the fusions are essential for separation of uranium (the product) for magnesium fluoride (the byproduct).

Likewise, following much European practice, in commercial reductions of uranium oxide by calcium in bombs, excess calcium is added over that for reaction stoichiometry so that remaining calcium will dissolve the calciumoxide byproduct and form a molten phase which will allow the molten uranium to separate. Again, pressures are high, bombs are expensive, and the use and handling of calcium are both more expensive and more difficult than with similar processes using magnesium (which, unlike calcium, is stable in air). Therefore, such calcium reductions are seldom used commercially in U.S. practice.

Because most current recycling of uranium involves the formation of uranium oxide, and because conversion of uranium oxide to uranium fluoride is expensive, it would be economically advantageous if means were available to reduce uranium oxide directly with magnesium. It would be of further advantage to be able to carry out the reduction at atmospheric pressure. Therefore, there is economic value and need for the present invention.

Several physical and chemical properties may be employed to make possible economical magnesium reductions of uranium oxide as in the present invention:

The very different densities of molten uranium (about 17.9 grams per cubic centimeter at 1150° C.) and solid magnesium oxide (about 3.4 grams per cubic centimeter at 1150° C.) could be used for the separation of product from byproduct if a substantially unreactive molten-salt phase of intermediate density could be selected. Very few compounds, however, offer a satisfactory combination of chemical stability against the reactants and products, suitable melting temperatures, and densities greater than 3.4 grams per cubic centimeter (to float solid magnesium oxide). Here one is limited to the chemically substantially identical lanthanides (lanthanum plus rare earths) plus strontium and barium for the cations with bromine and iodine for the anions. These bromides or iodides could be used alone or together as the required molten-salt solutions to float magnesium oxide and sink uranium.

Bromides are expensive, but iodides are more expensive, so bromides will usually be chosen as anions. Strontium and separated rare earths (except cerium) are expensive. Thus, most molten-salt solutions will contain $BaBr_2$, $LaBr_3$, or $CeBr_3$ as the heavy salt. To save money and still keep a density of at least 3.4 grams per cubic centimeter, the heavy salts may be diluted with cheaper salts which are still fairly heavy, e.g., $BaCl_2$, $LaCl_3$, or $BaCl_3$. In the following discussions, the term "molten-salt solution" is used, but it is understood that the term also covers substantially pure molten salts of density at least 3.4 grams per cubic centimeter.

The reactants have very different densities, as well. At 1150° C. the densities are about 1.53 grams per cubic centimeter for molten magnesium and 10.7 grams per cubic centimeter for solid $UO_2$. By making pellets of magnesium plus uranium oxide at rough reaction stoichiometry (e.g., $2Mg+UO_2$), it is possible to achieve pellets of densities which will sink in the said molten salt solutions. Such pellets, however, will not be stable when they become hot—rather, when they reach temperatures sufficient for reasonably rapid reaction to magnesium oxide and uranium products, they will tend to overheat locally, break apart, and disperse as small fragments which will settle (upward or downward) only slowly.

The different densities of molten uranium, molten salt, and solid oxides allows construction of traps which will pass molten uranium but retain molten salt and solid oxides. Thus, a tube placed vertically into a cup of molten uranium can be used to support a column of molten salt held up by the said molten uranium. For example, if the density of a molten salt (e.g., 3.5 grams per cubic centimeter) is one fifth the density of molten uranium (about 17.9 grams per cubic centimeter), a 5-cm depression of the molten uranium down the said tube will result from adding a 25-cm column of molten salt onto the molten uranium. The presence of uranium oxide (density about 10.7 grams per cubic centimeter) in the molten salt will cause a somewhat greater displacement of molten uranium from the said tube, but the said tube and cup of molten uranium can still be used to form a trap to pass molten uranium while retaining molten salt and solid oxide.

Solubilities of MgO, $UO_2$, and Mg in the molten salt solutions of the present invention will vary with temperature and the solution components. Such solubilities may range to as much as several percent of a solution's composition. These solubilities are expected to be important to the present invention:

The solubility of MgO in the said molten-salt solutions is important because it will permit recrystallization of flocculent MgO precipitates into more compact crystals—as compared with flocculent precipitates, compact crystals are easier to drain (after being dipped out from a molten-salt solution) and are expected to be substantially freed of attached, unreacted $UO_2$, an advantage for radioactivity removal.

Dissolution of some Mg and $UO_2$ in the said molten-salt solution, spreads the regions in which the Mg-$UO_2$ reactions can take place, thereby making the reaction faster and more complete that if the solubility did not exist.

Likewise, dissolution of Mg in the said molten-salt solutions lowers the thermodynamic activity of the Mg, thereby allowing the Mg to be retained in solution at temperatures above the normal boiling point of the Mg (1090° C.). Thus, even if the Mg does not immediately react with $UO_2$, its chance of vaporization will be reduced by the said dissolution. In corollary, there will be reduced demand upon vapor-condensation and pumping devices needed to return vaporized Mg to the reaction zone.

The densities, solubilities, chemical stabilities, and concepts just discussed are coupled together in unique and unobvious ways to arrive at the method of the present invention. The need for the invention is demonstrated by the high cost of present practice in disposing of uranium oxide (particularly depleted uranium oxide from which most isotope $U^{235}$ has been removed) waste and the high cost of purchases of new material to replace that which might have been recycled but, instead, was buried.

SUMMARY OF THE INVENTION

An object of this invention is a method of reacting magnesium and uranium oxide at substantially atmospheric pressure within a molten-salt solution and under inert gas so as to produce and separate a molten-uranium product.

A further object of this invention is a method of producing uranium from uranium oxide by reduction without the use of either $UF_4$ intermediate or calcium reductant.

A still further object of this invention is to establish molten-salt compositions which are substantially inert toward uranium, magnesium, and their oxides and which have densites as molten salts and molten-salt solutions which are greater than 3.4 grams per cubic centimeter.

A still further object of this invention is methods of adding reactants into molten-salt solutions.

A still further object of this invention is apparatus for carrying out the methods.

Additional objects, advantages, and novel features of the invention will be set forth in part in the descriptions which follow, and in part will become apparent to those skilled in the art upon examination of the following or may be learned by practice of the invention. The objects and advantages of the invention may be realized and attained by means of instrumentalities and combinations particularly pointed out in the appended claims.

To achieve the foregoing and other objects, and in accordance with the purpose of the present invention, as embodied and broadly described here, the method of this invention comprises:

holding a molten-salt solution of density greater than 3.4 grams per cubic centimeter in a container means, adding uranium oxide to the said molten-salt solution, adding magnesium to the said molten-salt solution in the region of the said uranium oxide, reacting the said magnesium and the said uranium oxide, thereby forming magnesium oxide and uranium, floating the said magnesium oxide up from at least part of the zone in which the said magnesium and the said uranium oxide react together, and sinking the said uranium down from at least part of the said zone in which the said magnesium and the said uranium oxide react together.

In a preferred embodiment, compacts in the form of pellets containing substantially stoichiometric mixtures of Mg and uranium oxide, formed by techniques known to those versed in the art, are dropped into a molten-salt solution (e.g., equimolar mixtures of $BaBr_2$ and $BaCl_2$) of density greater than 3.4 g/cc and held at a temperature of about 1150° C. Within the said molten-salt solution, the said pellets are heated to conditions in which the pellets disintegrate, primarily by reacting to form uranium and MgO but also in part by dissolving Mg and uranium oxide into the said molten-salt solution and by melting and vaporizing the Mg. Molten-uranium product collects below, and MgO floats to the surface region of, the said molten-salt solution so that uranium and MgO can be removed separately. The solubility of Mg and $UO_2$ reactants in the molten-salt solution, when combined with solution stirring (e.g., by the falling pellets), provides a means for these reactants to get back together even if they have failed to react as the pellets of their origin disintegrated.

Two preferred embodiments are offered for removing reaction products from the container holding the molten-salt solution. In one case both uranium and MgO are dipped (ladled) out from the molten-salt solution. Because the MgO tends to carry considerable amounts of the molten-salt solution along with it, its dipper is made of perforated or porous material which will allow at least part of carried molten-salt solution to drain off. In the second case the uranium is removed through a trap, thereby producing uranium which is essentially free of MgO and salt.

Two preferred embodiments are also offered for recycling Mg which has failed to react with uranium oxide and has escaped from the region occupied by the molten-salt solution. In one case the upper region of the molten-salt solution is above the boiling point of the Mg, and Mg vaporizes to a condenser from which condensed Mg is returned by gravity to a tube which enters the molten-salt solution region. A pumping device, represented as propellers, pumps the low-density Mg into the Mg-uranium oxide reaction region where MgO and uranium form. Depending upon several factors of heat transfer, solubility, pressure, and local temperature, the Mg leaving the tube may be liquid, vapor, or solution. In a second case the upper region of the molten-salt solution is below the boiling temperature of the Mg (because of a temperature gradient from the molten uranium up to the top of the molten-salt solution). Here Mg which had failed to react is carried back into the reaction region of the molten-salt solution by falling uranium oxide (as shown) or by falling pellets of Mg-uranium oxide.

The molten-salt solutions are primarily drawn from those indicated in Background of the Invention, i.e., bromides and chlorides of barium, lanthanum, and rare earths, separately or in mixtures. As also indicated earlier, iodies are suitable as heavy components of solutions which require densities greater than 3.4 g/cc, and many halides are suitable as less expensive diluents of the expensive components.

In a still further aspect of the present invention in accordance with its objects and purposes, the apparatus of the invention comprises:

a container means which acts also as a conduit means, a trap means within the said container means, the said trap means being filled with molten uranium, and the said molten uranium supporting molten-salt solution of density greater than 3.4 grams per cubic centimeter.

BRIEF DESCRIPTION OF THE DRAWINGS

The accompanying drawings, which are incorporated in and form a part of the specification, illustrate various embodiments of the present invention and, together with the description, serve to explain the principles of the invention. In the drawings.

DESCRIPTION OF THE PREFERRED EMBODIMENTS

Figure 1:
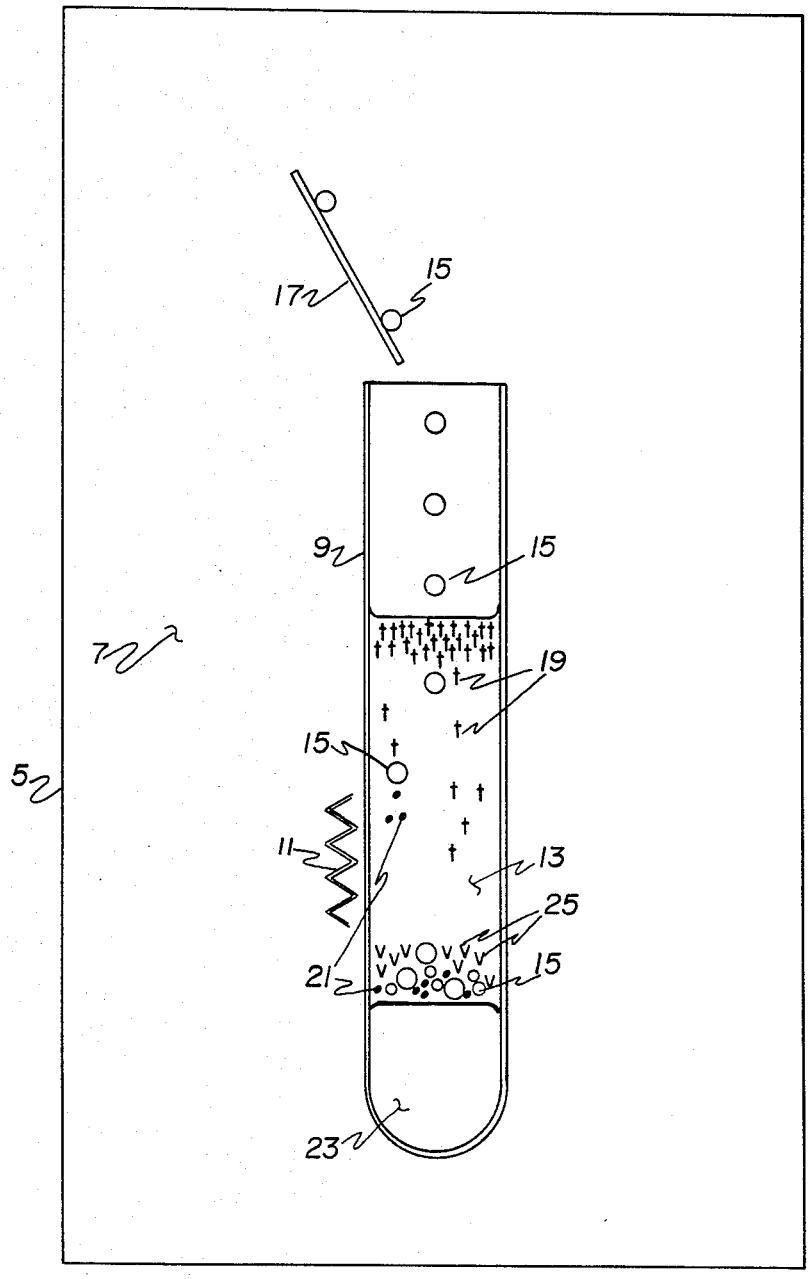
FIG. 1 is a schematic illustration in cross section of an embodiment of an apparatus of the invention showing addition of compacts of magnesium-uranium oxide mixtures (in this case pellets) which will sink into a high-density, molten-salt solution and react to form uranium and magnesium oxide. Without compaction, the magnesium and uranium-oxide reactants would separate as they were added to the molten-salt solution. The products of the reaction separate with uranium sinking into a molten-uranium region and MgO rising to near the top of the molten-salt solution.

Among the preferred embodiments, FIG. 1 shows a glove box 5 built and operated using techniques known to those versed in the art. The glove box 5 is filled with an inert atmosphere 7. Inside the glove box 5 there is a container 9 heated throughout to over the melting point of uranium (e.g., to approximately 1150° C.) by at least one heater 11. Insulation (not shown) surrounds the heater 11 and the container 9. The container initially holds a molten-salt solution 13 of halide salts of density greater than 3.4 grams per cubic centimeter; for example, an equimolar solution of $LaBr_3$ and $LaCl_3$ with density about 3.7 grams per cubic centimeter could be used.

Compacts, in this case in the form of pellets 15, of magnesium mixed with uranium oxide, supplied by feeder 17, fall into and sink in the molten-salt solution 13. (Technology for fabricating pellets and feeders such as those used here is known to those versed in the art. Where the uranium oxide present could be represented as $UO_2$, the pellet composition would be substantially one mole of $UO_2$ to two moles of Mg.) As the pellets 15 heat in the molten-salt solution 13, the reaction of magnesium with uranium oxide from the pellets produces uranium and magnesium oxide. As the pellets decompose and disintegrate, magnesium oxide 19 floats to the surface region of the molten-salt solution 13, and molten uranium 21 sinks out of the molten-salt solution 13 and forms a first-configuration molten-uranium region 23. Because the reaction of any pellet 15 may not be complete, some uranium oxide 25 may be left near the bottom of the molten-salt solution 13, and some magnesium may rise. The magnesium and uranium-oxide reactants, especially the magnesium, are somewhat soluble in the molten-salt solution 13. Such solubility serves to spread out the magnesium-uranium oxide reaction zone, and, even more important, the solubility of magnesium also serves to hold magnesium in solution at temperatures above the normal boiling point of magnesium (1090° C.). However, at least some of the unreacted magnesium will be expected to rise to the surface of the molten-salt solution 13 and escape as a vapor.

Figure 2:
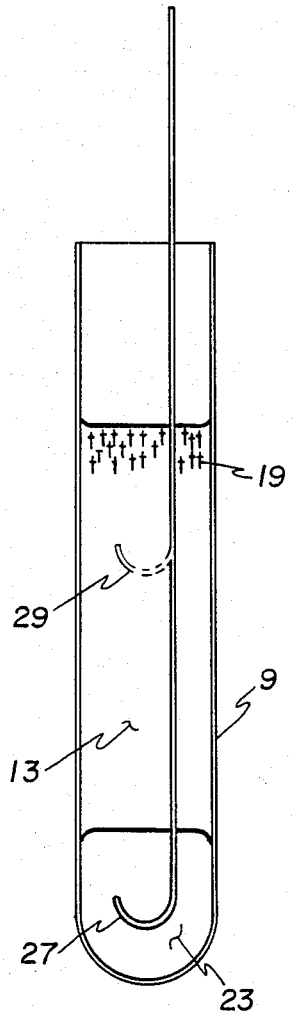
FIG. 2 is a schematic illustration in cross section of an embodiment of an apparatus of the invention in which dippers are used for removal of molten uranium and solid MgO formed in a molten-salt solution. The MgO dipper is porous or perforated to allow drainage of the molten-salt solution. Such drainage is not necessary with the molten-uranium dipper.

FIG. 2 shows a preferred embodiment for removing from container 9 both magnesium oxide 19 and molten uranium from the first-configuration molten-uranium region 23. In this case a dipper cup 27 and a dipper strainer 29 have been mounted on a single handle; in other cases separate dippers will be preferred. When the dipper cup 27 is raised out of the container, the dipper cup 27 remains substantially full of molten uranium and essentially free of molten salt or solid magnesium oxide or solid uranium oxide. When the dipper strainer 29 is raised, it removes magnesium oxide 19 but largely drains off molten-salt solution 13.

Drainage of molten-salt solution 13 from the magnesium oxide in the dipper strainer 29 will be aided if the initial flocculent magnesium oxide precipitate has been allowed time for grain growth by recrystallization catalyzed by magnesium oxide dissolved in the molten-salt solution 13. Additionally, the recrystallization will aid in removing traces of uranium oxide originally carried in the flocculent magnesium oxide precipitate. Removal of such uranium oxide assists in the control of radioactivity associated with uranium compounds. When the magnesium oxide removed from the molten-salt solution 13 has been cooled, the associated (now frozen) halide salts from the molten-salt solution 13 can be substantially recovered by aqueous solvents or other solvents so that the halide salts can be returned to the molten-salt solution 13.

Figure 3:
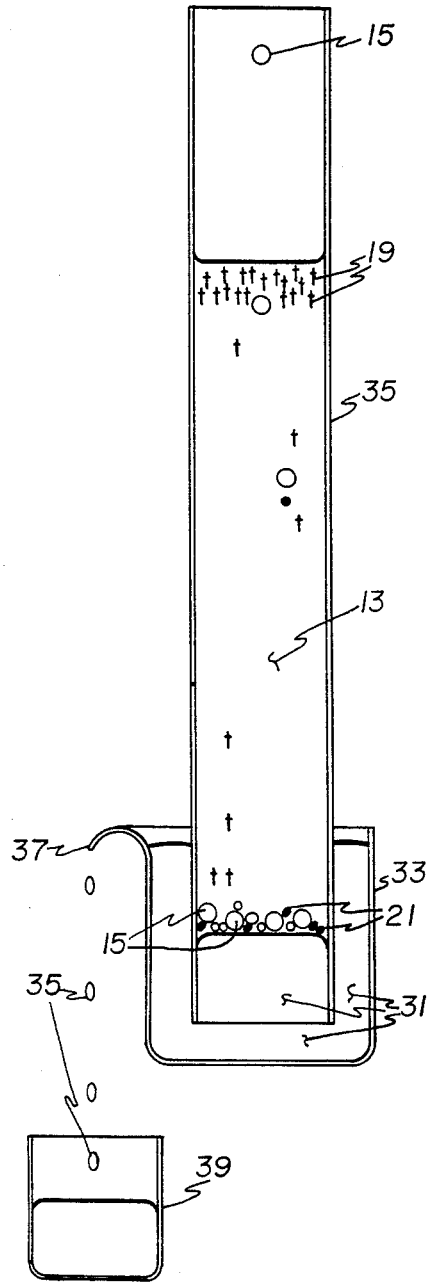
FIG. 3 is a schematic illustration in cross section of an embodiment of an apparatus of the invention in which a trap filled with molten uranium allows molten uranium formed in a molten-salt solution above the said trap to pass through the said trap while the said trap retains the said molten-salt solution and oxides.

FIG. 3 shows another preferred embodiment for removing molten uranium, in this case through a second-configuration molten-uranium region 31. Here the second-configuration molten-uranium region is held in a cup 33, and the container 9 of FIG. 1 is replaced by a tube 35. Above the second-configuration molten-uranium region there again is a molten-salt solution 13. Addition of magnesium-uranium oxide pellets 15 to the molten-salt solution causes a series of events which result in addition of molten uranium 21 and correlated discharge of molten uranium 35 from the second-configuration molten-uranium region 31, out of the cup lip 37, and into the billet mold 39. Removal of magnesium oxide 19 is by dipper strainer as in FIG. 2.

Figure 4:
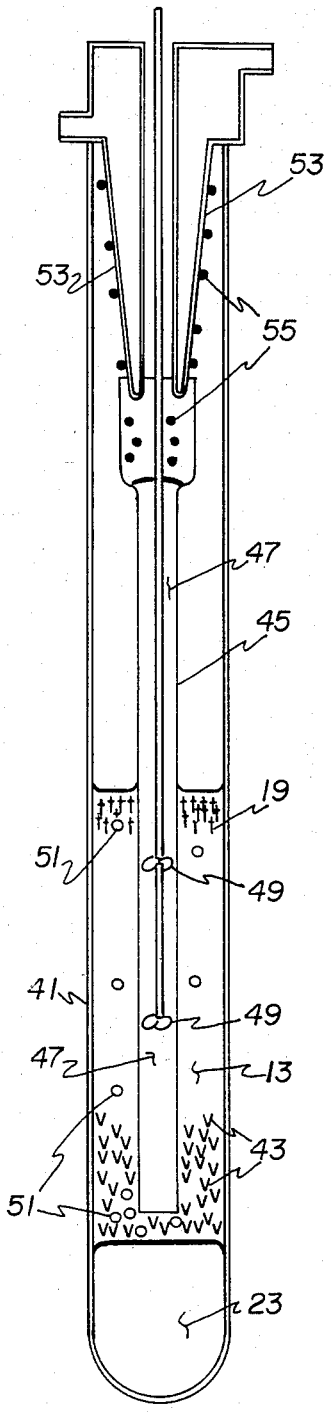
FIG. 4 is a schematic illustration in cross section of an embodiment of an apparatus of the invention in which a combination of Mg-vapor condenser and Mg pump is used for recycling Mg vapor which has escaped from an Mg-uranium oxide reaction. This apparatus applies primarily if the top of the molten-salt region is above the boiling point of Mg.

In FIG. 4 is shown a preferred embodiment of an apparatus for recycling magnesium which has failed to react with uranium oxide and has escaped from the region occupied by the said uranium oxide. Here a longer container 41 has replaced the container 9 of FIG. 1. Uranium-oxide powder 43 is shown in the molten-salt solution 13, but magnesium-uranium oxide pellets as in FIG. 1 could also be used for reactant additions. Again magnesium oxide 19 is a product of the uranium-forming reaction.

A conduit means in the form of a tube 45 with larger upper region contains a molten-magnesium region 47. A pumping means, represented by propellers 49 (but various types of pumps are known to those versed in the art), drives magnesium out of the molten-magnesium region 47 through the lower portion of the tube 45, forcing magnesium vapor or droplets 51 to rise into and react with uranium-oxide powder 43, to dissolve in the molten-salt solution 13, or to rise up through the molten-salt solution. Magnesium which passes through the molten-salt solution moves as vapor to a condenser 53 from which condensed magnesium 55 returns to the molten-magnesium region 47. The condenser 53 is taken off periodically to allow removal of reaction products, i.e., magnesium oxide 19 and uranium 23. Magnesium can be added to the tube 45 and uranium oxide can be added to the molten-salt solution 13 through conduit means (not shown) through the condenser 53.

Figure 5:
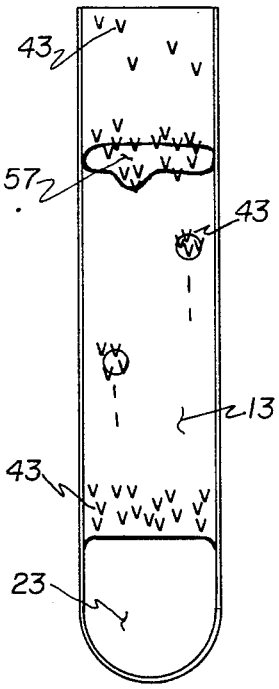
FIG. 5 is a schematic illustration in cross section of an embodiment of an apparatus of the invention in which floating, molten Mg is returned to a primary reaction zone in a molten-salt solution by attaching Mg to uranium oxide (powder shown here, but compacts also could be used) which sinks through the molten Mg. This apparatus applied primarily if the top of the molten-salt region is below the boiling point of Mg.

In FIG. 5 is shown another preferred embodiment for recycling magnesium to the reaction zone. In this case a temperature gradient in the molten-salt solution 13 is developed so that unreacted, floating magnesium 57 can exist (temperature below 1090° C., the magnesium boiling point) at the top of the molten-salt solution 13 while molten uranium is present (temperature above 1133° C., the uranium melting point approximately) at the bottom of the molten-salt solution 13. Uranium-oxide powder 43, dropped onto the floating magnesium 57 partially reacts with, attaches to, and weighs down some of the floating magnesium 57 causing part of the originally floating magnesium to sink into the molten-salt solution 13. Further magnesium needed for stoichiometry of the reaction is supplied as discussed regarding FIG. 1 or 4.

We claim:

1. A method of reacting uranium oxide with magnesium to produce uranium comprising:

(a) holding in a container, a molten-salt solution comprising halides of lanthanides, strontium, and/or barium and having a density greater than 3.4 grams per cubic centimeter, (b) adding solid uranium oxide to the said molten-salt solution, thereby placing the said molten-salt solution in contact with the said solid uranium oxide, (c) adding magnesium to the said molten-salt solution, (d) dissolving at least some of the said magnesium into the said molten-salt solution, (e) reacting the said magnesium and the said uranium oxide, thereby forming magnesium oxide and uranium, (f) separating by density differences the said uranium and the said magnesium oxide in the said molten-salt solution, and (g) removing separately the said uranium and the said magnesium-oxide from the said molten-salt solution.

2. A method according to claim 1 in which the said molten-salt solution is held at a temperature sufficient to melt the said uranium formed.

3. A method according to claim 2 in which at least part of the said molten uranium periodically is dipped out of the said container means.

4. A method according to claim 2 in which at least part of the said molten uranium periodically is dipped out of the said container through a trap filled with molten uranium.

5. A method according to claim 1 in which at least part of the said magnesium oxide periodically is dipped out of the said container.

6. A method according to claim 5 in which the said dipping allows the said molten-salt solution to drain from the said magnesium oxide.

7. A method according to claim 1 in which the said magnesium and the said uranium oxide are added as compacts to the said molten-salt solution.

8. A method according to claim 7 in which the said compacts are in the form of pellets.

9. A method according to claim 1 in which one or more conduit means are used to supply the said magnesium into the said molten-salt solution.

10. A method according to claim 9 in which the said magnesium is pumped through the said conduit means and into the said molten-salt solution.

11. A method according to claim 1 in which magnesium which has failed to react and has floated or vaporized to the surface of the said molten-salt solution is returned into the said molten-salt solution for reaction with the said uranium oxide.

12. A method according to claim 11 in which the said magnesium at the said surface of the said molten-salt solution moves as a vapor to a condenser and is thereby condensed and is thereafter returned into the said molten-salt solution through the said conduit means.

13. A method according to claim 11 in which the said magnesium at the said surface of the said molten-salt solution is attached to uranium-oxide powder and sinks with the said uranium-oxide powder into the said molten-salt solution.

14. A method according to claim 1 in which the said reaction of magnesium with uranium oxide takes place within an environment at substantially atmospheric pressure.

15. A method according to claim 1 in which the said reaction of magnesium with uranium oxide takes place within an environment of substantially inert gas.

* * * * *